US007299735B2

(12) United States Patent
Alford

(10) Patent No.: US 7,299,735 B2
(45) Date of Patent: Nov. 27, 2007

(54) DEVICE FOR THE DISRUPTION OF EXPLOSIVE ORDNANCE

(76) Inventor: Sidney C. Alford, 41 a Pickwick, Corsham, Wiltshire SN13 0HX (GB)

( * ) Notice: Subject to any disclaimer, the term of this patent is extended or adjusted under 35 U.S.C. 154(b) by 0 days.

(21) Appl. No.: 10/500,880

(22) PCT Filed: Jan. 8, 2003

(86) PCT No.: PCT/GB03/00044

§ 371 (c)(1),
(2), (4) Date: Oct. 7, 2004

(87) PCT Pub. No.: WO03/058155

PCT Pub. Date: Jul. 17, 2003

(65) Prior Publication Data

US 2005/0081706 A1 Apr. 21, 2005

(30) Foreign Application Priority Data

Jan. 8, 2002 (GB) ..... 0200267.3

(51) Int. Cl.
*F42B 33/00* (2006.01)

(52) U.S. Cl. ..... 89/1.13; 86/43; 86/50; 89/1.14

(58) Field of Classification Search ..... 86/50, 86/25, 43; 102/443, 447, 431, 432; 89/1.13, 89/1.14

See application file for complete search history.

(56) References Cited

U.S. PATENT DOCUMENTS

| | | | | |
|---|---|---|---|---|
| 2,083,665 | A * | 6/1937 | Pihl et al. | 102/431 |
| 2,532,323 | A * | 12/1950 | Miller, Jr. | 102/364 |
| 4,385,546 | A * | 5/1983 | Lee | 86/36 |
| 4,852,451 | A * | 8/1989 | Rogers | 86/33 |
| 4,862,567 | A * | 9/1989 | Beebe | 86/43 |
| 5,399,187 | A * | 3/1995 | Mravic et al. | 75/228 |
| 5,493,973 | A * | 2/1996 | Brion et al. | 102/431 |
| 5,708,231 | A * | 1/1998 | Koon | 102/439 |
| 5,936,184 | A | 8/1999 | Majerus et al. | |
| 5,943,749 | A * | 8/1999 | Swank | 86/54 |
| 6,317,946 | B1 * | 11/2001 | Beal | 102/516 |

FOREIGN PATENT DOCUMENTS

| | | |
|---|---|---|
| DE | 2 555 649 | 12/1975 |
| DE | 3 623 240 | 10/1987 |
| GB | 2 292 445 A | 2/1996 |

* cited by examiner

*Primary Examiner*—J. Woodrow Eldred
(74) *Attorney, Agent, or Firm*—Workman Nydegger

(57) ABSTRACT

A plurality of embodiments of disruptor all have a container with an enclosure for explosive material with a wall which can he located in any one of a number of different positions using one or more tubular spacers (12) optionally of various sizes thereby to provide a wide range of capacity of enclosure and hence explosive material.

13 Claims, 8 Drawing Sheets

DEVICE FOR THE DISRUPTION OF EXPLOSIVE ORDNANCE

The present invention relates to a device for the disruption of a wide range of types of explosive ordnance.

It is frequently required to disassemble items of conventional explosive ordnance and of improvised explosive devices such as may be fabricated by terrorists and criminals, in order to render them safe. Unless a suitable method of disassembly is carefully applied, any intervention may cause the target to explode. One traditional method consists of manual separation of components in such a way that the initiating mechanism is rendered unable to operate. By means of remotely controlled manipulators, this disassembly may be carried out at a safe distance in order to protect the operator from injury were the target device to explode or ignite during the intervention.

Another commonly used method consists of the very sudden disruption of the target device using a charge of high explosive. This method depends upon the separation or breaking of components of the initiation mechanism, or the separation of the initiation system from the main explosive or pyrotechnic charge, before the device has time to function.

This method is most easily applicable to mechanically weak, improvised explosive devices (IEDs).

Alternatively, when rendering safe a more robust conventional munition believed not to have a sensitive fusing system, (such as an air-dropped, steel-cased bomb), the shock generated by the explosive method may be used to cause the explosive fill to be ignited without detonation. Confinement of the copious gas produced by the decomposing explosive usually results in a non-detonative "low order" explosion which bursts the case open and scatters any remaining explosive.

Such explosive methods may consist of a simple "donor" charge of high explosive, such as plastic explosive or a block of trinitrotoluene, placed close to, or in contact with, the target device. A great disadvantage of this type of attack is that it yields unpredictable results, and unwanted detonation of the target munition frequently occurs.

Explosive may alternatively be used as the source of power in a tool for the disruption of explosive targets; such a tool is commonly known as a "disruptor". In this case, the explosive used is usually a non-detonative propellant rather than high explosive and it is used to propel a disruptive projectile from a gun barrel; it may alternatively be high explosive used as a component of a "shaped charge".

In the latter case, which is usually but not exclusively used against conventional munitions, (usually encased in such hard materials as steel or aluminium alloy), one end of a small explosive shaped charge is provided with a metal-lined, radially symmetrical, cavity. This metallic liner is collapsed by the progressive detonation wave front so as to generate an extremely fast-moving jet of metal. This penetrates the case and injects hot metal into the explosive or pyrotechnic fill, causing it to ignite or to explode. Such charges are usually employed at "stand-off" distances corresponding to four or five charge diameters. In a variant of such disrupting charges, the use of a cavity liner provided with only shallow concavity yields a projectile consisting of a coherent mass, or "slug", of hot metal which can be projected over relatively great distances, typically equivalent to tens or hundreds of charge diameters. The impact of such projectiles frequently causes the target munition to detonate as a result of the shock wave generated, and is sometimes intended to induce such detonation but, if the hot injected material causes the fill to ignite rather than to detonate, the internal pressure generated by the gaseous combustion products usually causes the case to burst violently, albeit without detonation. Such violent disruption often causes the burning residual explosive to be extinguished but the method always carries the risk of unwanted detonation.

A further method in which high explosive is used for attacking conventional munitions is the use of sheet explosive for the projection of a flat plate in order either to make a hole of large diameter in a target munition or, alternatively, to knock off the external nose fuse of a shell or bomb.

Disruptors consisting of a robust, smooth-bore, gun barrel employ a blank propellant cartridge to project an inert mass at the target munition. This mass may consist of metal shot, a steel slug, or particulate metal in a plastic, viscous aqueous or plaster matrix. Such a method is most commonly used to project water at relatively thin-skinned improvised targets in order to burst them open or to remove the end-cap from a pipe bomb. One particular variant is the use of a rifle, usually of large calibre, such as 0.5 inch, to strike the munition from an armoured vehicle at a safe distance. Such weapons are used for the disruption of mines, sub-munitions, explosive projectiles and steel-cased aircraft bombs. One of my earlier inventions, described in British Patent Specification GB2292445, consists of a disrupter which combines the advantages of high explosive as a propellant with water as a projectile and which projects water at much higher velocities than are ordinarily attainable using a gun barrel using shaped charge configurations in which the cavity in the explosive charge is lined, or is filled, with water or other liquid or liquescent material.

In order to be prepared to carry out successful render-safe procedures (RSPs) on the multiplicity of possible types of target devices charged with explosive or pyrotechnic composition which he may encounter, the explosive ordnance disposal (EOD) operator presently needs a corresponding multiplicity of tools. These, typically, include malleable plastic explosive, sheet explosive, detonators, two or three types of metal shaped charge case, a gun for projecting water, and another for projecting steel slugs or chisels, as well as factory-filled cartridges and, in some cases, shaped charges.

Existing devices in which high explosive is used as the propellant are almost invariably used in conjunction with a metal projectile, such as a copper or iron cone, dish or plate. The body is usually made of steel or aluminium. According to national practice, the device may be issued to the user pre-filled with explosives in a factory or it may be issued uncharged, and the filled extemporaneously by the user using plastic or, occasionally, liquid explosive.

Most such devices are derived from the technology developed for use as shaped charge warheads in armour-piercing missiles and the user has no control over their performance other than choosing the point of aim and the stand-off distance.

In the case of one such pre-filled device, the manufacturer provides a series of brass discs which the operator can place between the disrupter and the target in order to mitigate the violence of impact of the jet of metal which it generates on the target munition. Such disruptors are commonly referred to as "weapons" and suffer the disadvantage that regulations require that they be acquired, transported, stored and issued as explosive items.

In variants of known inventions, in which the body of the disruptor is supplied empty to be loaded by the operator with plastic explosive immediately before use, the dished or conical projectile is fixed at one end by means of a crimp in the extremity of the case or it is a sliding fit within the body and urged against an internal rim at one end by the explosive which the operator tamps behind it. The means of initiation is usually a detonator and the part supporting it usually consists of a disc or plug with an axial hole. Such arrangements have the advantage of giving the operator an additional variable parameter: although the explosive properties of one military plastic explosive varies but little from another, the amount of explosive used, and hence the energy output of the device, can be varied by the operator. The limitations even of these disruptors are such that they are generally used for only one type of intervention on a target munition, the so-called "low-order" disruption of shells and bombs in which the case is penetrated by hot metal which ignites the explosive fill; this burns so vigorously that the case cannot stand the copious volume of gaseous combustion products and bursts violently. This method frequently results in unwanted detonation (or "high order" reaction).

The high probability that disruptors and donor charges of explosive fired in contact with conventional munitions, such as bombs dropped from aircraft, will cause unwanted detonation of the target munition is attributable to the large amounts of explosive required for such operations according to usual contemporary practice and to the diameter of such charges. A contact charge large enough in diameter and thickness to perforate reliably the steel case of a typical air-dropped bomb, which may be as much as twenty five millimetres thick, is precariously close to the size sufficient to detonate its fill and such unwanted detonations occur frequently when they are used.

Not only is the quantity of explosive required often sufficient to induce such detonation but the diameter of the charge needed to induce reaction of the target munition's contents is frequently excessive. In order for detonation to occur throughout a mass of explosive it is necessary for a high pressure shock wave to run far enough for the explosive decomposition it induces to become self-sustaining. This is known as the "run distance" and is a constant for a given explosive. The distance that the requisite high pressure shock wave will be maintained as it passes through an explosive target is a direct function of the diameter of the zone of its surface subjected to explosive attack and, in contemporary EOD practice, this is such that the run distance is likely to be exceeded for the types of explosive most often used for filling munitions.

Many of the resulting unwanted detonations are then frequently but erroneously attributed to the known process of "burning to detonation" or "deflagration to detonation transition" (DDT), which process consists of an initially combustive reaction which accelerates exponentially under the condition of confinement until a shock wave is generated which results in the detonation of the remaining explosive fill. In fact, many of these incidents are attributable to direct shock initiation by the donor charge or to the indirect action of the high velocity, high density, and wide-bodied projectile striking its surface.

Those gun barrel disruptors which project water are of two general types: those in which the water is pre-loaded into the same cartridge as the propellant and those in which the propellant, which is a fast burning powder of the type used in conventional small-arms cartridges, is loaded in a blank cartridge case. The water is then poured into the barrel where it is retained by a plastics or rubber plug. Such disruptors have the disadvantage of powerful recoil and limited projectile velocity. Since most are made of steel, they are too heavy for deployment by small remote-controlled vehicles. The use of materials of lower density than steel increases the velocity of recoil. Such recoil may be reduced by the simultaneous discharge of water or gas rearwards but the advantage of such an arrangement is largely negated by the extra weight of the additional components required for this purpose and the increased blast and projectile effect behind the disrupter.

A variant of the gun barrel projects a steel slug rather than water. Such a slug may be flat-nosed or it may have one end in the shape of a chisel. Such projectiles are sometimes employed to remove end-caps from pipe bombs and nose fuses from such conventional munitions as shells and mortar bombs. They have the significant disadvantage of a potential range of hundreds of metres so constitute potentially dangerous missiles if they miss, or bounce off, the intended target. It is one purpose of the present invention to make such potentially dangerous procedures unnecessary by substituting liquid projectile materials or materials of lower density or combustible materials which, if unconstrained, have much shorter ranges.

The present invention discloses a disruptor for providing an explosive charge, the disruptor comprising a container having a projectile and explosive material, the container comprising: an enclosure for holding explosive material, said enclosure having a wall locatable at any one of a number of positions thereby to define the capacity of said enclosure.

In this way, the present invention allows a disrupter to have any of a range of capacities of explosive material enclosure.

It is important for an explosive material enclosure to be substantially completely filled with explosive material in order for the resultant jet to be accurately and precisely predetermined.

If the enclosure is not completely filled, the presence of pockets of air and/or air gaps in the explosive material disrupts the radial symmetry of the detonation wave front and in so doing prevents the symmetrical deformation of the projectile and causes it to deviate from its axial trajectory.

Also the present invention allows a disruptor to be provided with a predetermined amount of explosive material, in that a disrupter can be prepared with a predetermined size of explosive material enclosure, and then the enclosure can be merely filled with explosive material until full, in the knowledge that a specific size of explosive charge is then available.

Preferably, the container comprises one or more spacer elements to hold the wall in one position and so define the enclosure, and accordingly also its capacity. A spacer element may be of annular form, or it may be a block or it may be or some other appropriate shape. A function of a spacer element function is to transmit the longitudinal force from the consolidating ring to the projectile in order to urge it against the explosive. It is not a solid shape of such density as would prevent the deformation of the projectile. Thus typically it is tubular or it could be a solid (eg cylindrical) block of such collapsible material as a solid plastic or metal foam. It is possible to have a spacer ring which is integral with a projectile. A spacer element may form part or all of the projectile; for example it may be a solid body (eg of plastic material or of magnesium, or of zirconium or of titanium) or it may have a hollow cavity available for subsequent filling (eg with water or other filler) just prior to use.

One or more spacer elements may be located within the container but outside the enclosure, and/or one or more of the spacer elements may be located within the container and in the enclosure. The spacer elements may be all of the same size and/or they may be of more than one size, thereby to provide overall variety of sizes of enclosure.

In this way, a disrupter can be provided with any of a large range of sizes of explosive material enclosures from a kit of a few component parts comprising a single size of container parts and a few spacer elements.

The container of the disrupter may be formed of two parts which are held together by any convenient interengagement, for example a screw-thread fitting, or a groove/recess fitting or interference fit by longitudinal splines or push-fit arrangement.

The wall of the enclosure may be associated with and/or form part of the projectile of the disrupter.

A disruptor may have a projectile of any one or more of the following forms:

(i) a cone;

(ii) a flat disc;

(iii) a wedge of V-shaped cross-section;

(iv) a hollow body for filling by material (eg water) prior to use.

The present invention provides a method of filling a disruptor comprising a container having a projectile and an enclosure for holding explosive material, the method comprising measuring out a quantity of explosive material, placing the quantity of explosive material in the enclosure, locating a wall of the enclosure so that the enclosure is filled with explosive material.

Preferably the method includes providing one or more spacer elements to hold the wall in one position and so define the enclosure.

The method may include measuring out a quantity by weight or by volume.

The present invention also provides a method of filling a disruptor comprising a container having a projectile and an enclosure for holding explosive material, the method comprising locating a wall of the enclosure at one position and placing explosive material in the enclosure until the enclosure is filled.

Preferably the method includes providing one or more spacer elements to hold the wall in one position and so define the enclosure.

Thus present invention may provide a disruptor comprising at least one or more of the following:

container with means to vary the capacity of explosive material held within the container; and means to effect a ready connection between the disrupter body, and/or explosive material and/or projectile means.

In this way, the disruptor can be readily assembled from a kit of parts such as to have a particular specified function.

Also, it is possible to provide a disruptor with any of a wide variety of different criteria by assembling together whichever of a number of different elements are appropriate. Thus, using a limited number of basic elements, a very wide range of disruptors can be quickly and easily constructed and provided.

The disruptor may have any one of the following features:

An enclosure with a wall positionable at any one of a number of locations to define the capacity of the container;

A spacer to define the position(s) of the wall of the enclosure;

The container and a layer of lacquer or similar moldable or fixable material;

Engagement means on the disruptor and/or the container and/or projectile means to effect ready connection there between;

Screw-thread means on the disrupter and/or the container and/or projectile means to effect ready connection there between;

Push-fit means on the disrupter and/or the container and/or the projectile means to effect ready connection therebetween.

The present invention also provides a kit of parts for the assembly of a disrupter including any one or more of the elements of a disruptor as defined in the present invention.

The present invention provides a means of disrupting and rendering safe a wide range of types of explosive or pyrotechnic munition or improvised explosive device.

The present invention comprises a container which is loaded by the user with a variable quantity of plastic explosive and a projectile. Both quantity of explosive and type of projectile are determined according to the nature of the target to be disrupted and according to the effect which it is required to produce thereupon.

One purpose of the invention is to provide the advantage of being inert and free from restrictions associated with the acquisition, transportation, storage and issuing of explosive devices until it is loaded with explosive by the user.

A further purpose of the present invention is to overcome the difficulties and expense inherent in using gun technology to project water, and to project water at much higher velocities than are ordinarily achievable with guns. This is made possible by the use of light plastics materials for construction of the case and high explosive as the propellant, thus avoiding the necessity of a robust barrel, and the use of shaped charge technology for imparting directionality to the projected water.

Since the invention uses cases which are advantageously, but not necessarily, formed from plastics materials, and employs high explosive as the propellant, the case disintegrates upon actuation. This means that energy is dissipated by the projection of small plastics fragments, and by the generation of a shock wave in the surrounding medium. Thus, no significant recoil is exerted upon its supporting structure. This renders possible its support and deployment by much smaller means than are required for conventional disruptors of comparable disruptive capability.

The energy imparted to the projectile material by a charge of high explosive is a function of the pressure generated by the detonation and of the duration of the high pressure. One optional feature of the present invention is a water-filled jacket which, by virtue of its high density compared with that of air, impedes the dispersion of the gaseous detonation products and thus prolongs the period during which the expanding detonation products act upon the projectile material. It will be understood that the effectiveness of such a jacket may be enhanced by filling with a material of higher density.

The present invention also incorporates the optional means of conducting disruptive operations not only in air but also under water. This increases considerably the scope of its applications. This means may consist of an elongate nozzle so arranged that all projectile material issues through an orifice of very small diameter at its apex. It thus may provide the additional advantage of permitting the striking of a very small target area while affording considerable protection to the surrounding area. This is of particular advantage when disabling a target device in which a small explosive charge is intended to disperse a larger quantity of toxic or biologically active material.

In one embodiment, the present invention is intended to strike a target munition over as small an area of its surface as possible in order to minimise the probability of shock-initiation of its explosive contents. This embodiment also provides the means of accelerating projectiles without concavity to such high velocities as are ordinarily associated with conventional shaped charges.

In order that the invention may more readily be understood, a description will now be given, by way of example only, reference being made to the accompanying drawings, in which:

FIGS. 1 to 10 show various embodiments of disruptor, each of which incorporates the features of the present invention as claimed.

Figure 1A:
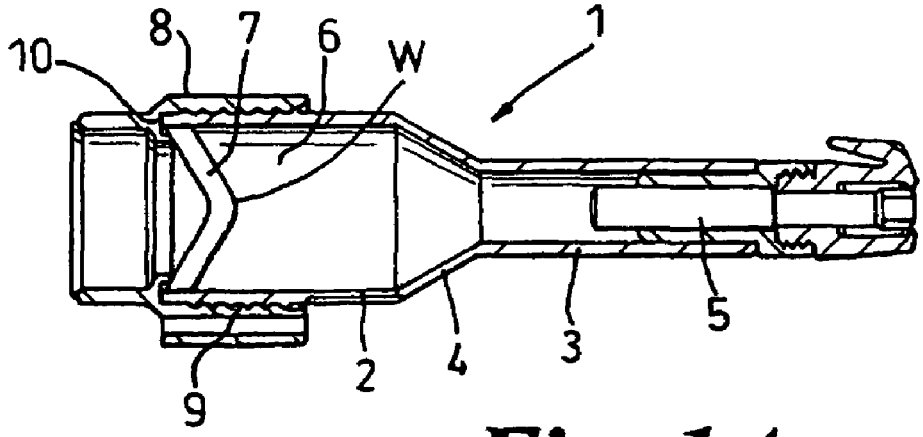
FIGS. 1A and 1B are assembled and exploded views of a longitudinal section of a disruptor of the present invention in which the projectile is propelled by a full charge of explosive.
Figure 1B:
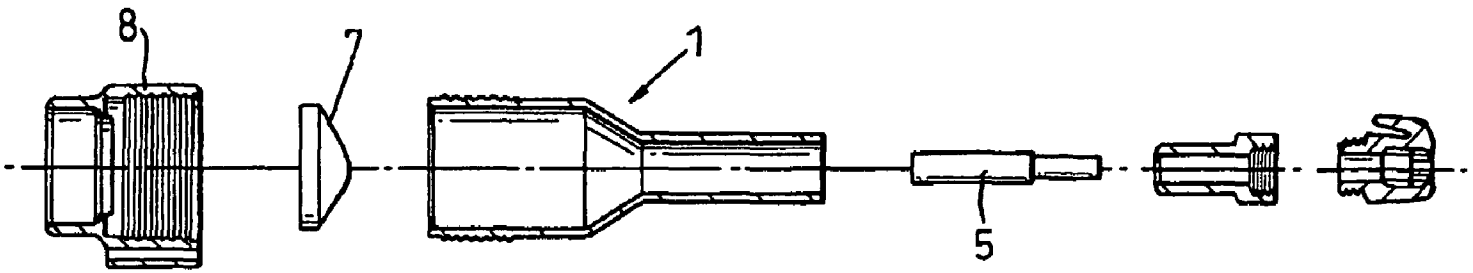

Referring to FIG. 1 of the drawings, plastics disrupter 1 consists of cylinder 2 which is provided with an axial tube 3 which serves to support the means of initiation which is most commonly a detonator D which is referenced 5. The tube 3 may conveniently be joined to cylinder 2 by a conical zone 4. During the process of loading, the detonator D may conveniently, and for the sake of safety, be occupied by a dummy detonator which is slightly shorter and slightly greater in diameter than the detonator which is to replace it.

The loading process consists of tamping a measured amount of plastic explosive into the cavity 6 within disruptor 1, extending from the end of the dummy detonator to the rear wall W of the projectile 7. When the maximum amount of explosive is used, the forward edge of the projectile 7 is in the same plane as, or a few millimetres proud of, the edge of disruptor 1. In this case the projectile 7 may be held inside the cavity 6 and urged against the explosive contained therein by the threaded consolidating ring 8 which engages with the externally threaded portion 9 of disrupter 1. The act of screwing the consolidating ring 8 onto disruptor 1 also ensures that the projectile 7 is axially aligned, as its edge abuts against the integral circumferential ridge 10 within the ring 8.

Thus disruptor 1 comprises a container formed of cylinder 2 and consolidating ring 8 and an explosive materials enclosure defined by cavity 6 and rear wall W of projectile 7, the enclosure completely filled with plastic explosive.

Figure 2A:
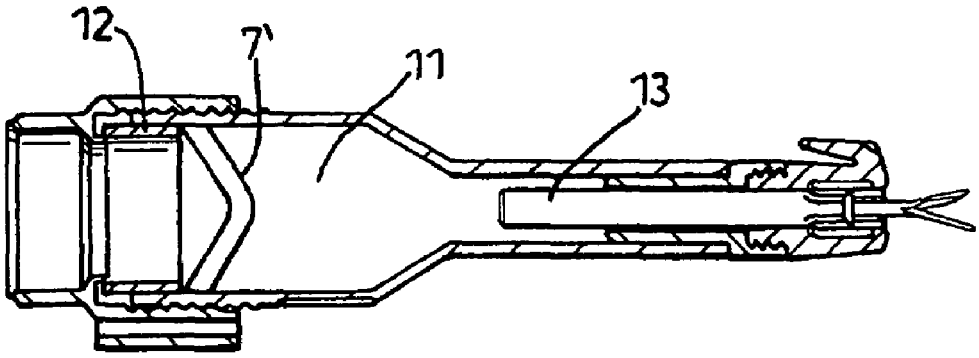
FIGS. 2A and 2B are assembled and exploded views of a longitudinal section of another embodiment of disruptor of the present invention in which the projectile is propelled by less than a full charge of explosive.
Figure 2B:
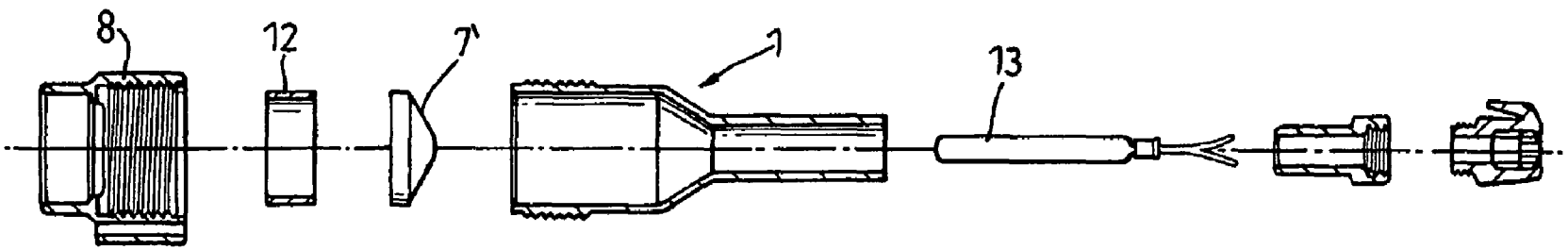

Referring to FIG. 2 of the drawings, a projectile 7' is shown in conjunction with a reduced explosive load 11. In this case, since the internal ridge 10 of the consolidating ring 8 cannot bear upon the edge of the projectile 7', a tubular spacer ring 12 is inserted in the cylindrical part 2 of the disrupter so that one end abuts upon the edge of the projectile 7'. The internal ridge 10 of the consolidating ring 8 then bears upon the other end of the spacer ring 12 so that screwing the ring 8 onto the body 1 urges the projectile 7' against the explosive 11, to be initiated by the detonator 13, ensuring the axial alignment of the projectile 7' in so doing.

The disruptor shown in FIG. 2 is essentially similar to that in FIG. 1, with the addition of spacer ring 12 which reduces the size of the enclosure and hence the explosive load 11 in the disrupter.

Filling of the explosive materials enclosure may be achieved in either of two ways.

In the first way, the explosive is measured by weight or by volume and then inserted into the explosive material enclosure in the body wherein it is first compressed, most usually by manual tamping, and then further compressed by the consolidating ring which acts either directly, or through the intermediary of one or more spacer rings (of a single size or of a variety of sizes) as required, on the forward surface of the projectile.

Alternatively, in another filling operation, the amount of explosive in the charge is determined by filling of the explosive material enclosure with such material by loading a slight excess of explosive into the body initially. After insertion of the projectile, the consolidating ring is used to exert longitudinal thrust either directly, or through the intermediary of one or more spacer rings, onto the forward surface of the projectile. The body, being provided with a preferably radially symmetric array of holes, allows any excess of explosive to be extruded through the holes until the consolidating ring, and any spacer rings, have advanced to a predetermined point. This point is constituted by an end-stop. Such an end-stop may s consist of a shoulder or ridge on the inside surface of the cylindrical part of the body.

Figure 3A:
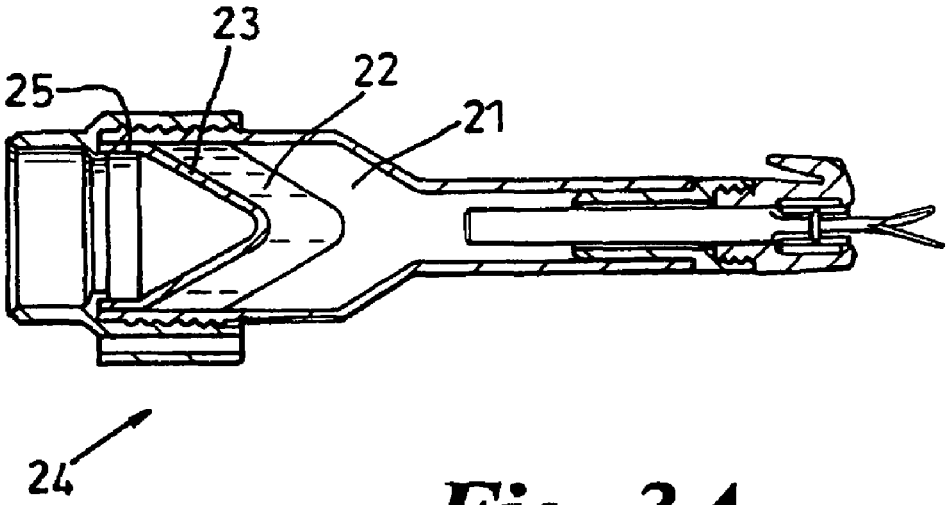
FIGS. 3A and 3B are assembled and exploded views of a longitudinal section of another embodiment of disrupter embodying the present invention in which the projectile consists of a cone of plastics and water.
Figure 3B:
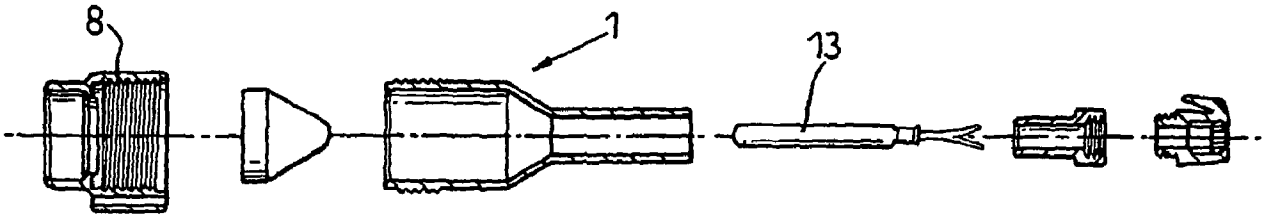

Referring to FIG. 3, a conical cavity is formed in the explosive charge 21 and the space in front of the cavity filled with water 22. If the explosive is not sufficiently resistant to contact with water, the interface may be consolidated by the application of a layer of lacquer to the exposed surface of the explosive or by the interposition of a thin plastics cone. The forward front of the water is defined by the insertion of a plastics cone 23, most conveniently made from polyethylene for the sake of its easy compliance, into the mouth of disruptor 24. This cone, being provided with an integral tubular spigot 25 which is tight-fitting, also acts as a stopper and contains the water. The assembly thus constitutes a shaped charge of generally commonplace form but with the projectile consisting of a cone not of metal but of a polyethylene and water composite. Though less penetrating, for a given mass of explosive, than a conventional shaped charge with a metal liner, the jet formed is still capable of penetrating even thick-skinned conventional munitions such as aircraft bombs and possesses considerable disruptive power. It is, however, very much less likely to induce deflagration or detonation of the explosive or pyrotechnic fill of the target munition so it constitutes an effective tool for the bursting open of small munitions, such as grenades and sub-munitions, with ejection of the fuses, in cases in which minimal violence or recovery and exploitation of components is an important consideration.

In this embodiment, spigot 25, cone 23 and the cavity filled with water together constitute the space-determining element such that the wall of the cavity defines the enclosure for the explosive charge 21 and hence the capacity of the explosive charge.

Figure 4B:
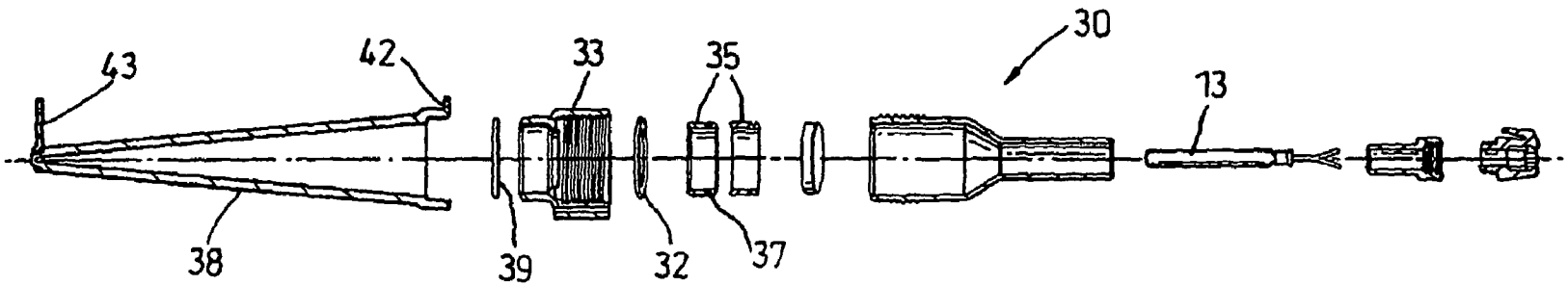
FIGS. 4A and 4B are assembled and exploded views of a longitudinal section of another embodiment of disruptor adapted for use under water by internal seals and application of a radially symmetrical elongate nozzle.

Referring now to FIG. 4 of the drawings, disruptor 30 is shown with a light explosive load 31 and adapted for use under water as well as in air. Since a small volume of explosive means that the projectile needs to be urged a greater distance down the inside of disrupter 30, a single spacer would not suffice to transmit thrust from the consolidating ring 33 to the projectile 34. In this case, two or more spacer rings 35 may be employed so that the thrust is exerted through the linear array of spacers. The use of more than one spacer (optionally of different sizes) can also be employed in other embodiments. In order to prevent the ingress of water via the thread 36 locating the consolidating ring 33 and disrupter 30, a flat rubber washer 32 is placed at the forward edge of the outermost spacer ring 35 and an O-ring 37 is located in an external circumferential groove in the most forward spacer ring 35.

An elongate cone or nozzle 38 fits on the forward end of the consolidating ring 33. An O-ring 39 fitted into a circumferential shoulder on the forward edge of the ring 33 provides a hermetic seal between the ring 33 and the nozzle 38. Since the apex of the nozzle 38 is closed by a thin, integral, diaphragm 40, the interior of the entire assembly is protected against the ingress of fluids so may be used under water.

If a projectile in the form of a disc 34 is propelled by an explosive charge contained within a case such as a disruptor of the present invention, the disc tends to disintegrate since each increment of the disc is propelled by the advancing detonation wave front along a notional line from the tip of the detonator through the centre of that increment and the fragments thus produced form a divergent pattern.

An important property of the nozzle 38 is that each of the fragments produced by this mechanism strikes the inner surface of the nozzle 38 at a very acute angle and, in consequence, does not perforate the wall of the nozzle 38 but is deflected along the inner surface of its lumen towards the apex. The projected material strikes the end diaphragm 40 almost normally so bursts through it and emerges as a projectile of very high velocity.

Since the wall of the nozzle 38 usually remains intact, the surface of a target attacked by this highly collimated projectile suffers no damage outside the impact zone.

This embodiment of the invention thus constitutes a means of striking a target with great precision and great selectivity. This is of particular value in the rendering safe of a munition which can be made incapable of explosion by the destruction of a specific component with minimal risk of dispersing ancillary components, such as toxic or radioactive substances forming part of, or adjacent to, the target munition. The nozzle 38 also provides a valuable aid to precise aiming in conditions of low light, as when diving in dark, dirty, water, or in conditions of difficult access, as in the case of a small target in an encumbered position on a floor where line of sight may not be possible. In such cases it suffices to place the tip of the nozzle 38 in contact with, or close to, the point of intended impact and to adjust the position of the rear of the assembly in order to determine the angle of attack.

It should be noted that this collimating property of an elongate nozzle is not limited to a flat projectile: it may advantageously be used in conjunction with concave or even slightly convex projectiles and may be considered as a novel type of shaped charge.

It is known in the art that a conventional shaped charge with a conical liner produces an elongate "jet" of metal of which the tip, which derives from the region of the cone near the apex, travels faster that the rear-most part of the jet, which derives from the peripheral region, as a result of the higher explosive to liner ratio. Thus, a velocity gradient exists along the jet from the tip to the rear. This causes the jet to increase in length as it moves until it breaks up into a series of small pieces travelling at different velocities and in slightly different directions. This phenomenon severely limits the range at which such a jet is effective and means that the optimal stand-off distance between charge and target is of the order of five charge diameters.

Since the projectile leaving the nozzle 38 emerges from a hole at the apex of the nozzle which has a cross sectional area much less than that of the originating projectile 34, it follows that the projectile must be highly elongate. The mode of its formation is very different from that of a conventional shaped charge and results from the squeezing of a disc whose increments are accelerated at approximately the same rate. Thus the velocity gradient characterising a conventional shaped charge jet does not occur and the rod-like projectile generated by means of the nozzle remains coherent to a greater degree. This implies the potential for attacking targets at much greater range than is possible with conventional shaped charges. The nozzle 38 may accordingly be advantageously be provided with a rear-sight 42 and detachable fore-sight 43.

As with conventional shaped charge disruptors, the invention may use conical projectiles of copper. The relatively high density of copper and its ductility make it suitable material for the generation of highly penetrating jets but such jets are powerful initiators of detonation. It follows that such an assembly constitutes an effective means of destroying target munitions by bringing about their detonation, especially if the point of aim is the booster which necessarily consists of an explosive, such as tetryl or RDX and wax, which is more easily detonated than is the explosive employed for the main charge, which is typically TNT, a mixture of RDX and TNT or a plastic bonded explosive.

If it is the intention of the operator to avoid detonation but rather to cause the ignition of the explosive or pyrotechnic fill, then the copper projectile may advantageously be replaced by one of magnesium. Not only does this metal possess a much lower density, which makes it a poor initiator of detonation, but its low melting point and its affinity for oxygen cause the collapsing cone to ignite. Thus the target projectile is penetrated and injected with exceedingly hot burning metal. This constitutes a powerful means of igniting the composition of the target munition.

An alternative for this purpose to a cone of such readily combustible metal as magnesium, which depends upon ambient oxygen for its combustion, consists of a projectile composed of a mixture of two metals, such as aluminium and nickel, or aluminium and palladium, which react exothermically if raised to the temperature at which the aluminium melts. This reaction, in which the two metals form an alloy, does not involve oxidation of either components so is independent of ambient oxygen.

Other possible materials for use as projectiles include zirconium and titanium.

It will be understood that any of the assemblies defined by the invention may be filled with explosive and assembled by the user extemporaneously but that the invention also lends itself to filling in a factory and provision to the user as an explosive charge needing only the insertion of the means of initiation by the operator.

Figure 4A:
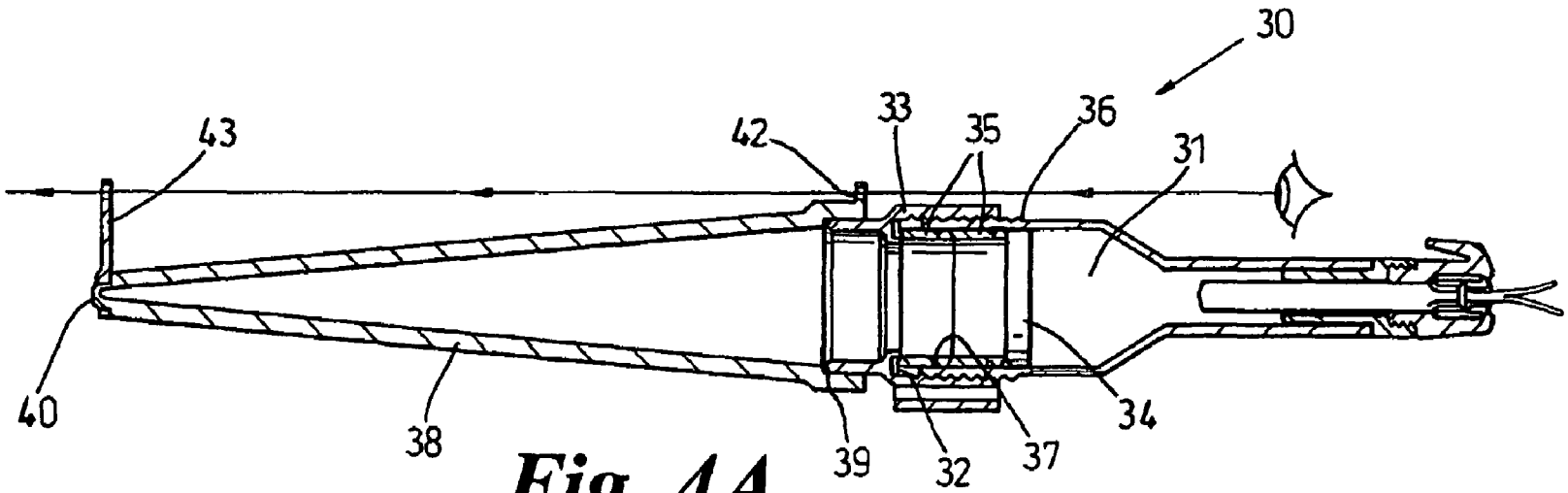
Figure 4C:
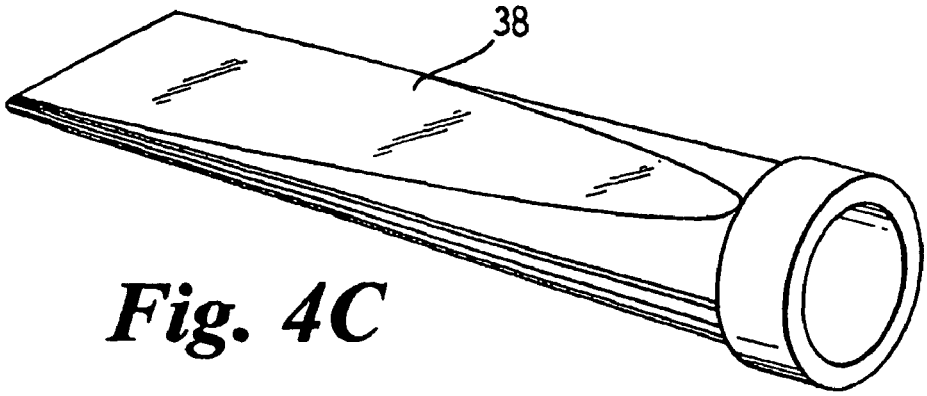
FIG. 4C is a perspective view of the nozzle of FIG. 4A.

FIG. 4C shows the nozzle 38 of FIGS. 4A and B.

Figure 5:
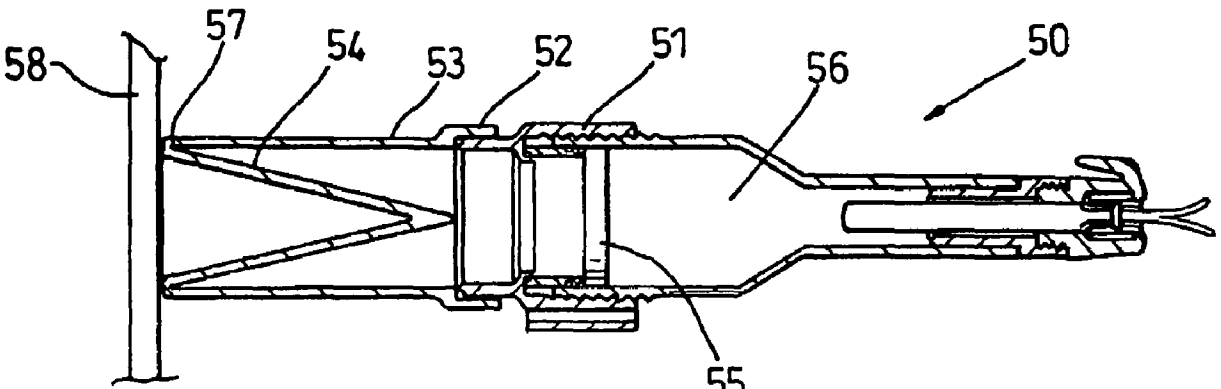
FIG. 5 is a longitudinal section of an embodiment of the invention adapted for trepanning.

FIG. 5 shows a disrupter 50 of the present invention in combination with such other components as bring it into the scope of one of my earlier inventions, the trepanning charge (UK Patent GB 2 105 015 B) which is used to effect cutting of a disc out of a target. In this arrangement, the forward end of the consolidating ring 51 is inserted in a cylindrical socket 52 on the end of a plastics cylinder 53. Within the cylinder 53 is an integral cone 54 which is attached to the distal end of the cylinder 53. It follows that the apex of the cone 54 is directed towards the disc-shaped projectile 55.

Upon detonation of the explosive charge 56, the projectile/disc 55 is propelled towards the cone 54 whereupon the apex of the cone 54 pierces the disc 55 which is progressively deformed as it passes along the inside of the cylinder 53 until it is projected through the annular groove 57 and emerges as an annulus travelling at such high velocity that it trepans a disc from a target 58 upon which the end of the cylinder 53 abuts. This embodiment of the invention provides a means of cutting large holes in target munitions using smaller amounts of explosive than are required by other explosive means. A large hole is preferable, for example, for the rapid flooding of sea mines in order to de-activate their firing mechanisms. It will be understood that the usefulness of this charge is not limited to the practice of explosive ordnance disposal but is of general applicability in explosive engineering.

Figure 6:
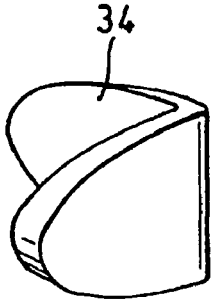
FIG. 6 is an angular projectile.

FIG. 6 shows the shape of projectile 34, for example of two inclined planes terminated by the line of intersection and by a cylinder of which the diameter is defined by this line, otherwise an ellipse folded across its short axis.

Figure 7:
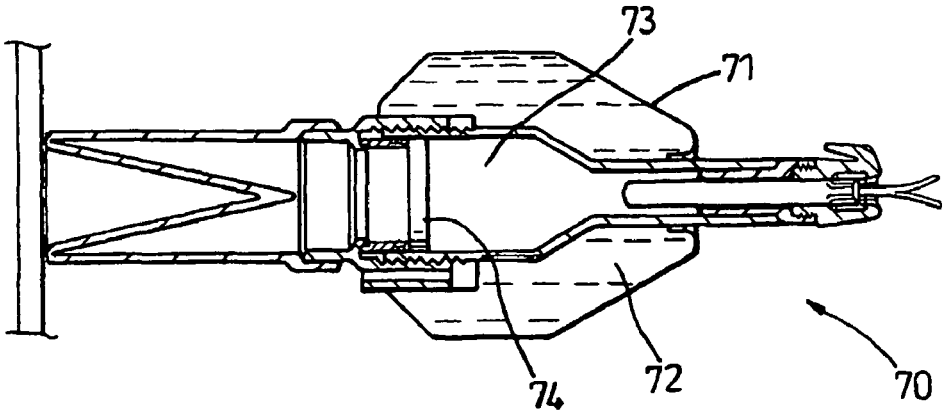
FIG. 7 is a longitudinal section of an embodiment of the invention adapted for trepanning and provided with a water-filled jacket.
Figure 8:
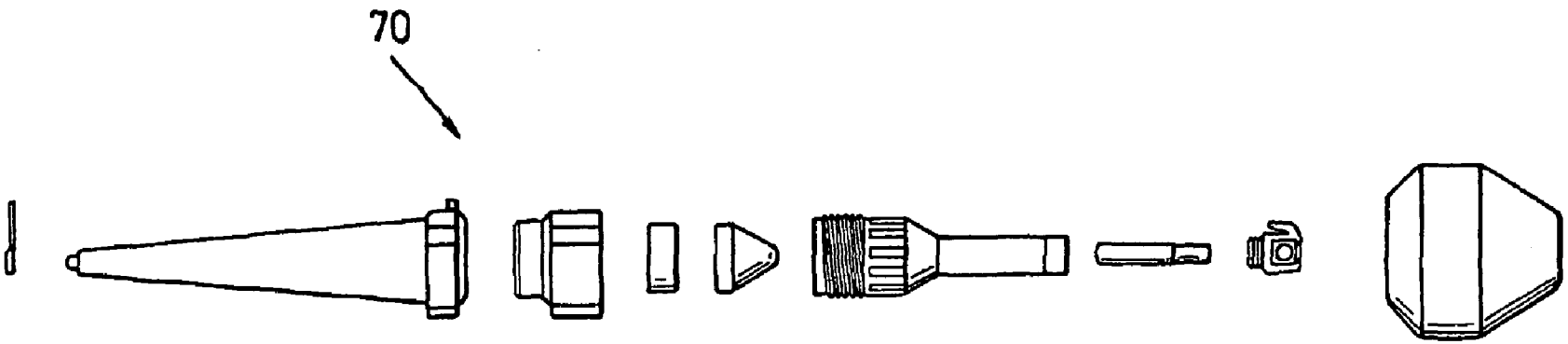
FIG. 8 is an exploded view of the disruptor of FIG. 7.

In FIG. 7, disruptor 70 is shown surrounded by a plastics jacket 71 which can be slid onto disruptor before the detonator is inserted. The effect of the water 72 which fills the jacket 71 is to confine the explosive charge 73 and thereby increase the amount of energy imparted to the projectile 74. It will be understood that the water 72 may be replaced by other liquids. A solution of ethylene glycol or of calcium chloride, for example, would lower its freezing point and maintain the liquid state when used at lower temperatures than the freezing point of water. Dissolution of such substances as calcium chloride or zinc chloride as increase the density would enhance the tamping effect. Since any liquid in the jacket 71 is instantly dispersed as fine droplets, a liquid containing a suitable reagent could be quickly mixed with any liquid or gaseous substances resulting from the rupturing of a target vessel. A powerful oxidising and sterilising agent such as a solution of calcium hypochlorite, for example, would denature nerve gases or bio-toxins and sterilise bacterial spores.

By way of example, a charge in which the projectile was polyethylene and water was loaded with 20 g of PE4 plastic explosive in which a 60° conical cavity was formed. The exposed surface of the explosive was sprayed with acrylic lacquer. After this had dried the remaining space was filled with water before insertion of a 60° polyethylene cone, 2 mm thick, apex first. The assembly thus constituted a shaped charge with a polyethylene and water conical liner. This was fired from a stand-off distance of 50 mm at a stack of six mild steel plates each 3 mm thick. All plates were perforated. The hole diameter increased from approximately 8.0 mm to 10.0 mm.

In an example of the use of a water and polyethylene lined shaped charge to disrupt a small bomb, a similar assembly was loaded with 20 g of C4 plastic explosive and aimed from a stand-off distance at a point midway between the driving ring and the start of the ogive of a Composition B-filled US 51 mm mortar bomb. The fuse was ejected and the case broke round the driving ring without apparent explosive reaction of the fill.

Another form of projectile material which evolves heat even in the oxygen-deficient interior of a munition is a heat-emitting pyrotechnic composition. Such compositions most commonly consist of a mixture of a fuel component, such a metal powder, and an oxidising salt, such as an inorganic nitrate, chlorate, perchlorate or chromate or the oxide of a heavy metal. They are therefore inherently potentially dangerous in storage and use. The present invention, which involves the violent distortion of the projectile, thereby provides the means of mixing two or more components which constitute separate entities in the undistorted projectile. Thus, by way of example, a shaped charge cone might be formed in two or more layers, each of a different reagent, so that mixing and ignition occurs only as the charge detonates and the cone is deformed. Suitable components for such a projectile might be magnesium and polytetrafluoroethylene. This mixture begins to react at about 493° C. with the evolution of a very large amount of heat according to the equation $$n(\text{—}CF_2\text{—}CF_2\text{—}) + 2nMg \longrightarrow 2nMgF_2 + 2nC$$

Yet another consists of a compressed or encapsulated oxidant which would react chemically with the oxygen deficient contents of the target munition. Thus TNT, which is a highly oxygen deficient explosive of unusually low melting point but of high stability, is relatively difficult to ignite by brief contact with even very hot metal which it tends to quench without reaction.

The explosive injection of a hot oxygen donor would constitute a more powerful means of ignition. Though the very high proportion of oxygen in, for example, potassium perchlorate, is an attractive feature in such an application, it has the rather high decomposition temperature of about 440° C. Silver nitrate and potassium permanganate, with decomposition temperatures of 305° C. and 240° C. respectively, are thus considerably more powerful instigators of combustion.

In a further example of this type of charge, two similar charges were each loaded with 30 g of PE4 and fired simultaneously and parallel to each other at the side of a British 81 mm mortar bomb from a stand-off distance 50 mm. Two holes, 45 mm between centres and 12 and 6.5 mm in diameter, were made in the bomb case and the fuse was ejected without reaction of the explosive fill.

The use of the invention to cause the ignition of explosive-filled munitions is illustrated by shaped charges projecting magnesium liners.

By way of example, a charge was loaded with 30 g of PE4 and a projectile consisting of a magnesium cone with an included angle of 120° and 3 mm thick. It was aimed at the driving band of a British RDX/TNT-filled fused 81 mm mortar bomb at a stand-off distance of 50 mm. The case was split and the explosive and the fuse ejected without detonation.

In a further example, a similar charge was aimed from a stand-off distance of 50 mm at the side of a plugged British 1,000 lb Mk 13 bomb at a point 350 mm from the base. The bomb contained an aluminised mixture of RDX/TNT/wax containing synthetic fibres to enhance mechanical strength and thus prevent cracking. The disruptor caused the bomb case to split longitudinally and an estimated 90 per cent of the explosive fill was ejected in a single lump and projected approximately 10 metres.

In an example of firing against a large, fused, munition, a 50 g load of C4 was used to fire a magnesium cone against the side of a US Mk 80 series 500 lb aircraft bomb filled with RDX/TNT. The bomb had both a nose fuse and a base fuse. It was attacked at a stand-off distance of 50 mm at a point 350 mm from the base. The case split open and the explosive fill was dispersed in mostly small pieces. Both fuses were ejected.

An example of the enhancement of target penetration by a disc afforded by an elongate nozzle is provided by a charge in which a 30 g load of PE4 propelled a 4 mm thick magnesium disc along the lumen of an elongate plastics nozzle with an included angle of 10° and a wall thickness of 3 mm. When placed normally to a thick steel plate with the apex of the cone resting upon it, a cavity 13.6 mm deep and tapering from 19 to 11 mm in diameter was formed.

An example of the highly directive qualities of an elongate cone is provided by a charge loaded with 10 g of C4 propelling a composite cone of polyethylene and water along the inside of a similar elongate plastics cone. This was directed at the capacitor of a fast acting high voltage firing circuit connected to a remote electric fuse bead. The circuitry included a switch consisting of a metal foil and paper sandwich which was penetrated as the disrupter was actuated. This initiating circuit, and two plastics containers of water, having a wall thickness of less than one millimetre, were contained within a cardboard box. Firing of the disruptor generated a jet of polyethylene and water which travelled at such velocity as to penetrate and discharge the capacitor before the remote fuse head had time to explode.

Despite some tearing of the cardboard box, the plastics containers of water were not ruptured.

A further example of the usefulness of the nozzle is illustrated by the firing of a similar charge to that used in the preceding example against the anti-lift fuse of a limpet mine attached to a steel plate under water. The mine was removed from the steel plate and the switch immobilised in such a manner as would have prevented the initiation of the mine.

The following example illustrates the functioning of the embodiment of the invention used for the purpose of trepanning. A charge was loaded with 30 g of PE4 and a projectile consisting of a disc of aluminium 2.8 mm thick and weighing 5.5 g. The charge was fitted to an ABS plastic trepanning attachment containing a 25° cone, the base of which rested upon a sheet of mild steel 6 mm thick. Upon detonation, the charge cut a neat hole 38 mm in diameter. A steel disc 26 mm in diameter was recovered.

Yet another example illustrates the applicability of the invention to the attack of munitions or other targets at large stand-off distances. A charge was loaded with 50 g of PE4 and a projectile consisting of a 150° copper cone 1.64 mm thick with a rounded apex. At a stand-off distance of 1400 mm it produced a very neat hole 17 mm in diameter through a 10 mm thick mild steel plate.

In FIG. 1 to 3, the tubular element to the left of ridge 10 mimics the corresponding end of one of other existing devices, the Jet. The importance of the shape is that it enable one to fit various components originally developed for the Jet onto a disrupter of the present invention. The square shoulder at its distal extremity is to accommodate an O-ring which seals the joint when the elongate nozzle 21 is attached for use under water. Another example of such fittings is the trepanning attachment 27.

Special features enabling the kit of parts to be assembled into different forms of disruptor include the following:

1. The consolidating ring (for example 8) is threaded internally so that it engages with the thread on the outside of the body 1. This enables the operator to press any of a variety of projectiles against the explosive within the body by screwing the consolidating ring onto the body until tight. It then holds the projectile in that position. This obviates the need of cement which has previously been necessary for such a purpose but which is inconvenient to use in the field.

2. The spacer (for example 12) provides a means of translating the pressure applied by the tightened consolidating ring 8 against whatever projectile is being used. Its use enables the operator to assemble a variety of charges with a variety of projectile thickness and with a range of explosive loads.

3. The projectile (for example 7) represents a cone made of magnesium which is employed when an incendiary effect on the target is required. It is thicker than a conventional shaped charge liner of such a diameter since the density of magnesium (1.7 g/cm$^3$) is much lower than that of metals more commonly used such as copper (8.95 g/cm$^3$). The nature of the projectile material and the shape enables the operator to assemble charges with a particular terminal effect on a target. This may be the ignition of an explosive or pyrotechnic fill by means of the low density, fiercely combustible magnesium, or the detonation of an explosive-filled target or the penetration of thick metal by means of a conical liner of a high density, non-igniferous metal as copper or tantalum. A projectile consisting of water and polyethylene, in which the polyethylene cone 15 serves principally to give shape to the water, constitutes a shaped charge with a liner of quite unusually low density and high thermal conductivity and is able to penetrate steel cases, to impinge upon explosives without causing their detonation or ignition, and to burst open target munitions or eject their fuses and thus render them safe. The relatively acute angle of the polyethylene cone 15, and of the cavity in the explosive 14, compared with that of the magnesium cone 7 is employed in order to enhance the penetration of the low density polyethylene and water composite projectile.

4. The purpose of the film of lacquer applied to the surface of the explosive 11 is to protect the explosive from the action of water. This is less important in the case of highly water resistant explosives, such as those which incorporate mineral oil in their composition, but it is advantageous in the case of explosives such as PE4 plastic explosive which contain hydrophyllic components in their composition and in the case of explosives which are soft and likely to undergo deformation if handled roughly. A more robust alternative to lacquer is a plastics former, for example in the shape of a cone or a diaphragm. Lacquer has the advantage, however, of conforming with any shape which might be imparted to the surface of the explosive.

Figure 9:
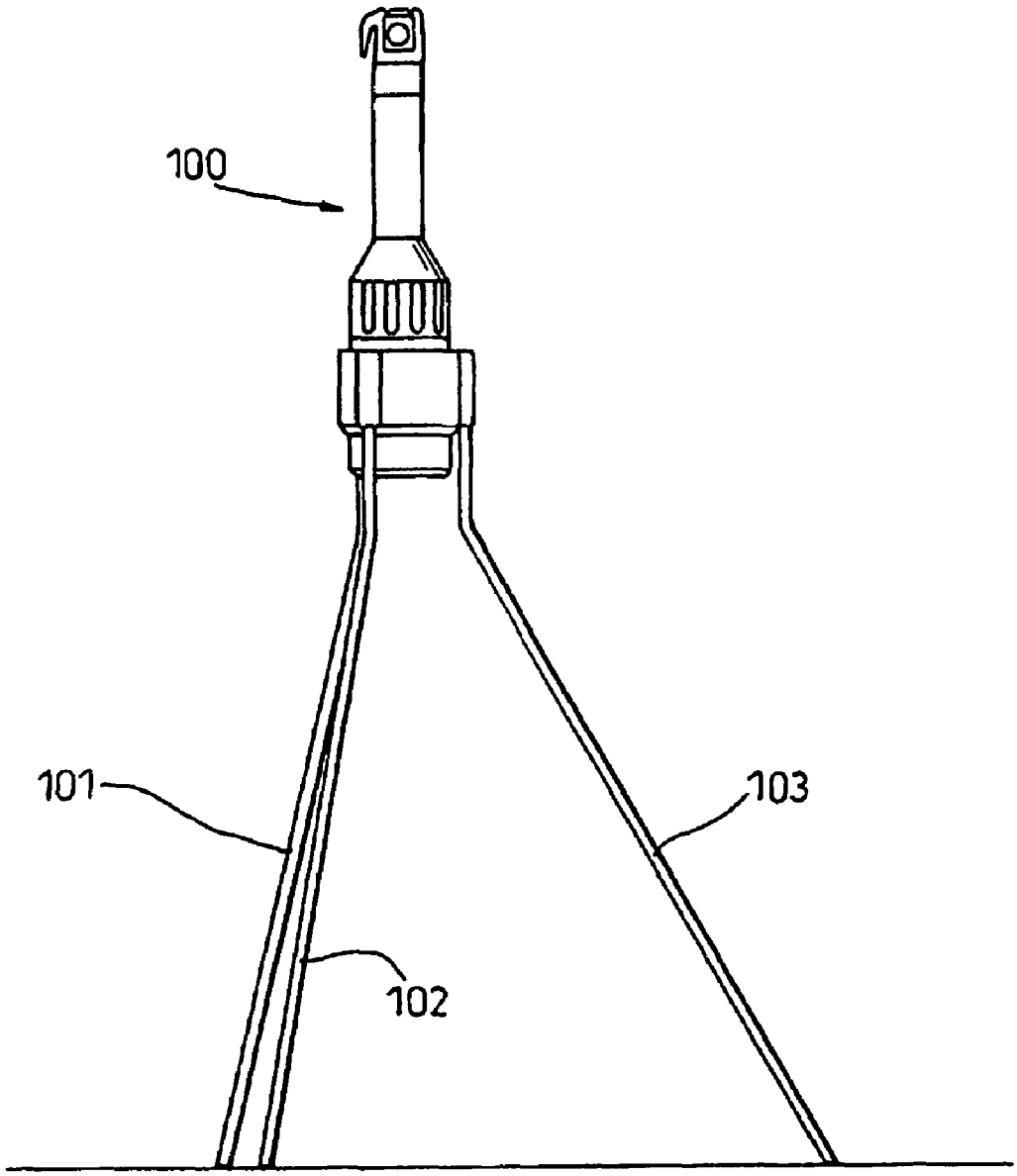
FIG. 9 is a disrupter of the present invention supported on tri-pod legs.

FIG. 9 shows another disrupter 100 which corresponds to the simplest of the variants described hereinabove, and having no nozzle, but with three wire legs 101, 102, and 103 spread equally to provide a secure support.

Three simple tools may be advantageously employed for loading charges made according to the invention.

Of these the first is a volumetric measure consisting of a plastics tube, the outside of which bears circumferential grooves on the outside to provide a firm grip. In the wider of the two grips shown, a lettered piece of polyethylenic heat-shrink tubing is collapsed. This is transparent and printed with the approximate explosive load which the measure contains when completely filled. By printing with mirror-image lettering and everting before shrinking it into position, the lettering may at once be read through the translucent plastic sleeve and be protected from abrasion by it.

The body of the measure may advantageously be made from polytetrafluoroethylene (PTFE) since explosive substances tend to stick less to it than to other plastics.

The measure is filled by pushing the angled end into a mass of plastic explosive on a clean work surface. When explosive extrudes from the square end, any excess may be removed by stroking with the stemming rod.

The wide end of the same stemming rod is then used to expel the explosive from the lumen of the volumetric measure in the form of a regular slug. The volumetric measure may conveniently have such dimensions as yield a slug of 20 g. This simple means enables the operator easily to prepare aliquots of explosive which are accurate to within less than 3%.

This combination of tools offers great ease of use in diverse working conditions, is simple to learn to use, applicable to all malleable plastic explosives and very inexpensive compared with the simplest of balances. Unlike a balance, it may readily be used aboard a ship.

The stemming rod is provided with one end which is narrower than the other. This facilitates the tamping of plastic explosive against the end of the dummy detonator. The wider end serves to consolidate the explosive in the rest of the case.

It is the purpose of the mandrel to provide the exposed surface of the explosive with a shape appropriate to the projectile about to be loaded. To this end, it has one square end and one with a 60° point.

The invention may usefully be used for the rendering safe of limpet mines attached to the sides of ships or other underwater structures. Once the presence of such a mine is recognised or suspected, the sooner the response the more likely it is to be successful. Time can be saved by loading the charge with explosive but no water. By providing the body with a series of holes round its periphery, water may be allowed to flood in within approximately one second after immersion in water. This arrangement allows the charges to be stored dry and so free of risk of water loss through leakage and free of the risk of freezing and distortion if subjected to a cold environment.

Figure 10:
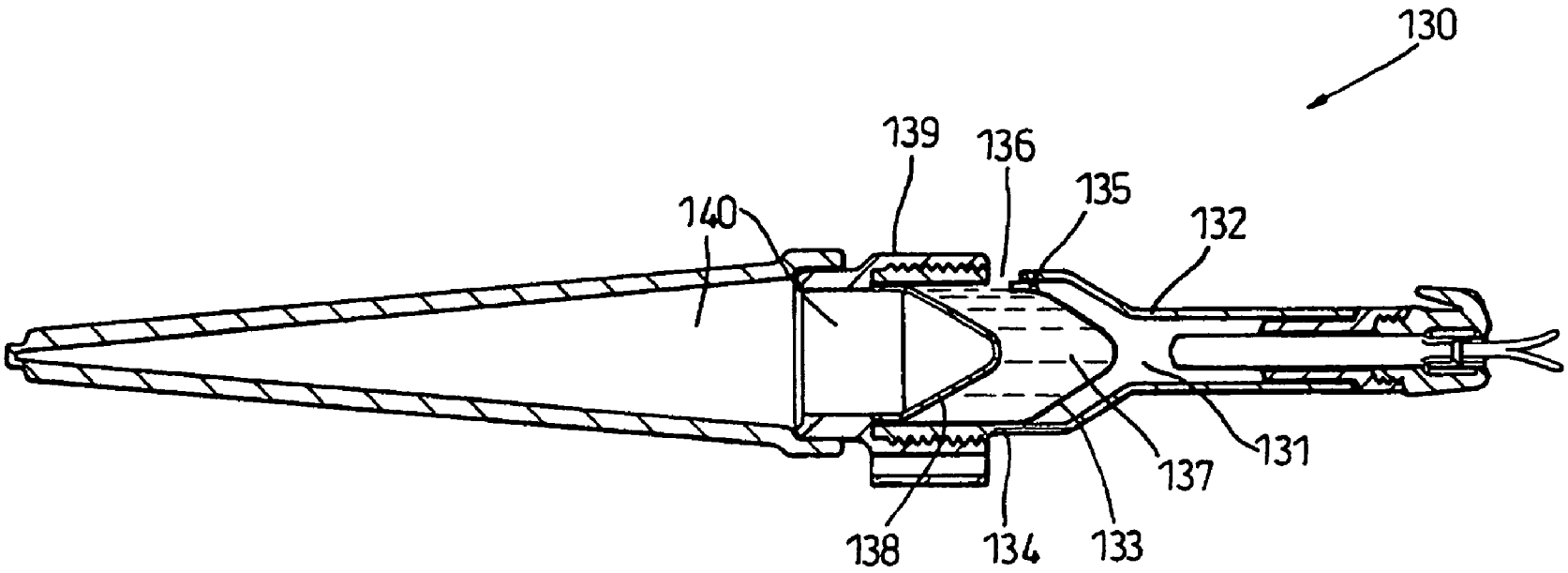
FIG. 10 is a further embodiment of disruptor embodying the present invention.

Referring to FIG. 10, there is shown a disruptor 130 for underwater use. Explosive 131 is loaded into the body 132 and the shape of its forward edge, which may be flat or provided with concavity is maintained by the flat or concave plastic diaphragm 133 which is provided with an integral spigot 134. This spigot 134 bears at least one hole 135 which is large enough to assure that a ring of holes 136 in the body will to a substantial extent be aligned with the holes 135. Thus, regardless of the rotational position of the diaphragm/spigot component 133 & 134, sufficient leakage path for surrounding water will occur to ensure that the cavity 137 forward of the diaphragm/spigot component 133 & 134 will be quickly flooded upon immersion.

The forward end of the cavity 137 is conveniently defined by a thin-walled plastics cone 138 which is integral with the threaded consolidating ring 139. This arrangement also ensures that the stand-off space 140 is maintained free of water.

In this embodiment, which is designed specifically for underwater use, the main component of the projectile is water 137, the forward edge of which is defined by a thin plastics cone 138 which is rigidly attached to, or integral with, either the body 132 or the consolidating ring 139. The volume of the water-filled cavity is therefore fixed. It is the conically formed surface of the explosive 131, or a thin plastics cone defining its forward surface which defines the rear surface of the water component of the projectile. The size of explosive materials enclosure is determined by the consolidating ring 139 and/or body 132.

The arrangement of FIG. 10 is particularly suited to underwater applications in that disruptor 130 can be manufactured and stored with cavity 137 empty, which is only filled with water once disruptor is put into position for use, whereupon water enters cavity 136 within 2 or 3 seconds of complete immersion in water.

In order to facilitate the use of the invention underwater, the open-ended threaded consolidating ring may be provided with an integral waterproof capsule which prevents the ingress of water into the stand-off space between the projectile and the target surface. Though the thread of the capsule can be waterproofed by the use of cement, PTFE tape or adhesive plastic tape, another means of sealing the assembly against the ingress of water is a rubber or plastic sleeve which is applied to the outside of the body. Such a sleeve may consist of rubber or of heat-shrinkable plastic.

The elasticity of a thin rubber sleeve is advantageous for application in the field although polyolefinic heat shrinking tubing with a meltable lining may be convenient when a means of applying heat is also available.

By way of example, a charge was loaded with 40 g of plastic explosive C4 and a magnesium cone and provided with a capsule which determined a stand-off space of 80 mm. It was fired against a 5 inch US fused shell filled with ammonium picrate (Explosive D) underwater at a depth of sixteen metres. The shell had lain on the sea-bed for several decades. The point of aim was approximately half way along the shell. The shell was penetrated and burst open as a result of low order reaction of its fill. This result dispels the commonly-held belief that such munitions cannot be low-ordered underwater and is significant as far as protection of marine fauna is concerned.

In a further example, a charge was loaded with 45 g of plastic explosive C4 and a copper cone. The charge was aimed along the long axis of a similar shell and pointed at the base fuse. The shell detonated.

In an example of the use of the disrupter in air, a charge was loaded with 20 g of plastic explosive PE4 and a magnesium cone and aimed from a distance of 50 mm at the side a steel-cased, TNT-filled Mk7/7 anti-tank mine in the open. The charge was thus aimed directly at the central fuze assembly. The shot resulted in the penetration of the case, blowing off the crimped steel cover of the mine and scattering the shattered explosive fill. Local soot deposition and a bulge round the entry hole indicated the participation of a very small proportion of the explosive fill in the event. No damage was caused to the fuze well, indicating that the reacting TNT had stopped further advance of the magnesium jet and thus protected the relatively sensitive fuze and booster from attack. This result is significant in that it dispels the commonly held belief that TNT-filled munitions cannot be low-ordered by explosive attack.

The invention claimed is:

1. A single-use disruptor including an explosive charge, the disruptor comprising a container for a projectile and explosive material, the disruptor and container for destruction in its single-use after detonation of the explosive material, the container comprising: an enclosure for holding explosive material, said enclosure having a wall of the projectile locatable at any one of a number of positions defining the capacity of said enclosure for explosive material, and one or more spacer elements to hold the wall in one position and so define the enclosure, wherein the one or more of the spacer elements are provided in the container but outside the enclosure.

2. A single-use disruptor according to claim 1 wherein one or more of the spacer elements are provided in the enclosure.

3. A single-use disruptor including an explosive charge, the disruptor comprising a container for a projectile and explosive material, the disruptor and container for destruction in its single-use after detonation of the explosive material, the container comprising: an enclosure for holding explosive material, said enclosure having a wall of the projectile locatable at any one of a number of positions defining the capacity of said enclosure for explosive material, and one or more spacer elements of annular form to hold the wall in one position and so define the enclosure.

4. A single-use disruptor including an explosive charge, the disruptor comprising a container for a projectile and explosive material, the disruptor and container for destruction in its single-use after detonation of the explosive material, the container comprising: an enclosure for holding explosive material, said enclosure having a wall of the projectile locatable at any one of a number of positions defining the capacity of said enclosure for explosive material; and one or more spacer elements to hold the wall in one position and so define the enclosure, wherein at least one of the one or more spacer elements comprises a hollow compartment for water or other filler material.

5. A single-use disruptor according to claim 1 wherein the projectile further comprises the one or more spacer elements.

6. A single-use disruptor according to claim 1 wherein the projectile is of one of the following shapes:

(i) a cone form;

(ii) a flat disc;

(iii) a radially symmetric body provided with a spherical, hyperbolic or other concavity;

(iv) a wedge of V-shaped section.

7. A single-use disruptor according to claim 1 wherein the projectile is made of one of the following materials:

(i) magnesium;

(ii) zirconium;

(iii) titanium.

8. A kit of parts for a disruptor according to claim 1, the kit of parts including a container for a disruptor, a projectile, an enclosure for holding explosive material having a wall of the projectile locatable at anyone of a number of positions thereby to define the capacity of said enclosure.

9. A single-use disruptor according to claim 1, wherein the enclosure comprises a detonator disposed in said enclosure for detonating said disruptor.

10. A single-use disruptor including an explosive charge, the disruptor comprising a container for a projectile and explosive material, the disruptor and container for destruction in its single-use after detonation of the explosive material, the container comprising: an enclosure for holding explosive material, said enclosure having a wall of the projectile locatable at any one of a number of positions defining the capacity of said enclosure for explosive material; and a consolidating ring that engages with a first end of the container;

an explosive material disposed in the container; and a projectile positioned in the container by the consolidating ring at any one of any number of positions to form an enclosure for the explosive material, wherein the projectile is axially aligned with an axis of the container by the consolidating ring and wherein a wall of the projectile is urged against the explosive material.

11. The single-use disruptor of claim 10, further comprising one or more spacer elements to hold the wall in a particular position.

12. The single-use disruptor of claim 10, further comprising a nozzle connected to the consolidating ring, wherein the nozzle collimates the projectile.

13. The single-use disruptor of claim 10, further comprising water positioned between the projectile and the explosive material.

* * * * *